United States Patent [19]

Croudace et al.

[11] Patent Number: 4,699,629

[45] Date of Patent: Oct. 13, 1987

[54] FUEL COMPOSITION AND METHOD FOR CONTROL OF OCTANE REQUIREMENT INCREASE

[75] Inventors: Michael C. Croudace, Huntington Beach; Timothy Wusz, Anaheim; Stephen G. Brass, Fullerton, all of Calif.

[73] Assignee: Union Oil Company of California, Los Angeles, Calif.

[21] Appl. No.: 805,442

[22] Filed: Dec. 5, 1985

[51] Int. Cl.[4] ..... C10L 1/16

[52] U.S. Cl. ..... 44/79; 585/14

[58] Field of Search ..... 585/14; 44/79

[56] References Cited

U.S. PATENT DOCUMENTS

| | | | |
|---|---|---|---|
| 2,080,681 | 5/1937 | Wilson | 585/14 |
| 2,208,105 | 7/1940 | Rathbun | 585/14 |
| 2,626,893 | 1/1953 | Morrow | 585/14 |
| 3,003,857 | 10/1961 | Carls | 585/14 |
| 3,361,545 | 1/1968 | Raymond et al. | 585/14 |
| 3,493,491 | 2/1970 | Barnes et al. | 585/14 |
| 3,703,361 | 11/1972 | Konecky | 585/14 |
| 3,817,721 | 6/1974 | Perilstein . | |
| 3,883,318 | 5/1975 | Feldman et al. | 585/14 |
| 3,999,960 | 12/1976 | Langer, Jr. et al. | 585/14 |
| 4,014,663 | 3/1977 | Feldman et al. | 585/14 |
| 4,145,188 | 3/1979 | Espenscheid et al. | 585/14 |

OTHER PUBLICATIONS

Guthrie, Petroleum Products Handbook, 1960, p. 12.

*Primary Examiner*—William R. Dixon, Jr.
*Assistant Examiner*—Ellen M. McAvoy
*Attorney, Agent, or Firm*—Dean Sandford; Gregory F. Wirzbicki; June M. Bostich

[57] ABSTRACT

The octane requirement increase phenomenon in a spark ignition internal combustion engine is controlled by introducing with the combustion charge a fuel composition containing an octane requirement increase-inhibiting amount of a compound selected from the group consisting of fused aromatics having at least 2, preferably between 3 and 5, aromatic rings with no heteroatoms substituted in the rings. Usually the polynuclear aromatic is added to the fuel in an amount between about 0.1 and 5.0 weight percent on the fuel. In particular, anthracene and phenanthrene, provide effective octane requirement increase-inhibiting additives for unleaded gasoline.

20 Claims, No Drawings

FUEL COMPOSITION AND METHOD FOR CONTROL OF OCTANE REQUIREMENT INCREASE

BACKGROUND OF THE INVENTION

This invention relates to improved hydrocarbon fuels which control the octane requirement increase (ORI) phenomenon observed during the initial portion of the operating life of spark ignition internal combustion engines.

The octane requirement increase (ORI) effect exhibited by internal combustion engines, e.g., spark ignition engines, is well known in the art. This effect may be described as the tendency for an initially new or clean engine to require higher octane quality fuel as operating time accumulates and is coincidental with the formation of deposits in the region of the combustion chamber of the engine. Thus, during the initial operation of a new or clean engine, a gradual increase in octane requirement (OR), the fuel octane number required for knock-free operation, is observed, accompanied by an increasing buildup of combustion chamber deposits until a rather stable or equilibrium OR level is reached. At the equilibrium OR level the accumulation of deposits on the combustion chamber surfaces no longer increases, but remains relatively constant. This so-called "equilibrium value" is usually reached between about 3,000 and 20,000 miles or the corresponding hours of operation. The actual equilibrium value of this increase can vary with engine design and even with individual engines of the same design; however, in almost all cases the increase appears to be significant. ORI values ranging from about 2 to 14 Research Octane Numbers (RON) are commonly observed in modern engines.

It is known that additives may prevent or reduce deposit formation, or remove or modify formed deposits, in the combustion chamber and adjacent surfaces and hence decrease OR. Such additives are generally known as octane requirement reduction (ORR) additives.

For example, in U.S. Pat. No. 4,264,335 to Bello et al., the cerous or ceric salt of 2-ethylhexanoate is disclosed as a useful additive for suppressing the octane requirement increase of a gasoline fired internal combustion engine. It is noted in this patent that the above salt has no effect on combustion efficiency of a gasoline and does not provide anti-knock properties.

In U.S. Pat. No. 4,357,148 to Graiff an additive is disclosed for controlling or reversing the octane requirement increase of a spark ignition internal combustion engine which comprises a combination of (a) certain oil-soluble aliphatic polyamines and (b) certain low molecular weight polymers and/or copolymers of mono-olefins having up to 6 carbon atoms.

U.S. Pat. No. 3,506,416 to Patinkin et al. discloses an additive to inhibit octane requirement increase of a spark ignition engine which comprises a gasoline soluble metal salt of a hydroxamic acid. This additive is disclosed as useful in leaded gasolines. Nickel and cobalt are especially preferred as the additives. In U.S. Pat. No. 4,444,565 to Croudace, on the other hand, an oil-soluble iron compound in combination with a carboxylic acid or ester is added to the combustion intake charge of an internal combustion engine to suppress the octane requirement increase.

Other references describing additives for inhibiting octane requirement increase include U.S. Pat. Nos. 3,144,311 and 3,146,203, which disclose utilization of nitrogen ring compounds in combination with an organo metallic primary anti-knock agent and a minor amount of an ignition control additive selected from the group consisting of phosphorus and boron compounds. And U.S. Pat. No. 3,817,721 discloses the use of high molecular weight alkyl aromatic hydrocarbons, or mixtures thereof, for reducing intake valve deposits formed in a spark ignition gasoline-fueled internal combustion engine.

While each of these methods has met with some success, the need exists for further developments in minimizing problems associated with octane requirement increase in internal combustion engines operating on unleaded gasoline. More specifically, a need exists for an additive for unleaded gasoline that reduces or prevents octane requirement increase.

SUMMARY OF THE INVENTION

It has now been found that a significant reduction in ORI is produced when a minor amount is dissolved in gasoline of a compound having at least 2, and preferably between 3 and 5, fused aromatic rings unsubstituted by heteroatoms contained in the rings. And in engines in which the "equilibrium value" of octane requirement has been reached, the octane requirement of the engine can be reduced from the "equilibrium value" by use of the fused aromatic additives of this invention.

Accordingly, the invention provides a method for operating a spark ignition internal combustion engine which comprises introducing with the combustion intake charge to the engine an octane requirement increase-inhibiting amount of one or more compounds having at least 2, and preferably between 3 and 5, fused aromatic rings unsubstituted by heteroatoms contained in the rings.

The invention further provides a motor fuel composition comprising a mixture of hydrocarbons boiling in the gasoline range of about 50° C. (122° F.) to about 232° C. (437° F.) containing an octane requirement increase-inhibiting amount of an additive comprising an organic compound having at least 2, and preferably between 3 and 5, fused aromatic rings which contain no heteroatoms substituted in the rings.

Further provided according to the invention is an octane requirement increase-inhibiting additive concentrate comprising (a) from about 50 to about 4000 grams per gallon of the above described fused aromatic compound and (b) the balance of a fuel-compatible diluent boiling in the range from about 50° C. (122° F.) to about 232° C. (437° F.).

DETAILED DESCRIPTION OF THE INVENTION

In the present specification and claims, one aromatic ring is considered fused to another when two carbon atoms in the first ring also are in the second ring. It is also possible for one aromatic ring to be fused to more than one other aromatic ring.

The terms "aromatic ring unsubstituted by heteroatoms contained in the ring" and "aromatic ring containing no heteroatoms substituted in the ring" are herein synonymous and refer to aromatic ring structures in which the atoms forming the ring are exclusively carbon.

The fused aromatic additives herein can be added with success to either leaded or unleaded gasolines, such as those used in automobiles having catalytic converters. An unleaded gasoline as herein defined is a gasoline containing less than 0.05 grams of lead per gallon of gasoline.

In the practice of this invention octane requirement increase caused by combustion of unleaded gasolines in a spark ignition internal combustion engine is suppressed or reversed by introducing with the combustion charge a fuel composition containing at least one fused aromatic compound having at least 2, and preferably between 3 and 5, fused aromatic rings containing no heteroatoms substituted in the rings. As used herein a fused aromatic compound contains at least 2 substituted or unsubstituted fused aromatic rings.

The fused aromatic compounds used in the invention are themselves well known. Examples of fused aromatic compounds suitable for use in this invention are acenaphthene, acenaphthylene, benzanthracene, naphthalene, anthracene, phenanthrene, amino anthracene, chrysene, coronene, 1,2,3,4-dibenzanthracene, 1,2,4,6-dibenzanthracene, dimethyl anthracene, dimethyl naphthalene, 9,10-diphenyl anthracene, ethyl anthracene, ethyl naphthalene, fluoranthene, fluorene, guaiazulene, methyl anthracene, methyl naphthalene, pentacene, perylene, pyrene, rubene, and triphenylene. In the preferred embodiment, the fused aromatic compound is selected from the group consisting of unsubstituted or substituted naphthalene, anthracene and phenanthrene, and more preferably still the fused aromatic compound is selected from the group consisting of phenanthrene and mono, di and tri butylated phenanthrene.

Fused aromatic compounds may be difficult to dissolve in the desired gasoline. To produce a gasoline-soluble aromatic, the compound is usually substituted with one or more gasoline-solubilizing organic radicals such as long chain alkyl or polyether radicals. Preferably the organic radical has between 1 and 23 carbon atoms, more preferably between 1 and 10 carbon atoms and is selected from the group consisting of substituted and unsubstituted alkyl, aryl, arylalkyl, alkyloxy, aryloxy, arylalkyloxy, alkenyl, alkenyloxy, alkynyl, alkynyloxy and arylalkenyl radicals and heteroatom-substituted hydrocarbyl radicals wherein the heteroatoms are selected from the group consisting of oxygen, sulfur, and nitrogen atoms. For example, the hereinabove described fused aromatics can be substituted with one or more polyether radicals having the general formula:

$$-R^1-0-R^2-0-R^3$$

wherein $R^1$, $R^2$ and $R^3$ are organic radicals containing between 1 and 10 carbon atoms and $R^3$ may specifically be another polyether group.

Preferably the polyether has the general formula:

$$-(CH_2)_{n1}-0-(CH_2)_{n2}-O-R^4$$

wherein $n_1$ and $n_2$ are integers between 1 and 10 and $R^4$ may specifically be another polyether group. As used herein an organic radical is a radical containing at least one carbon atom. The aromatic compound can also be substituted with inorganic species bonded to one or more carbon atoms in the ring structure of the aromatic compound. The inorganic substituent can occur together with an organic substituent in the same ring.

The concentration of the fused aromatic additive provided in fuels according to this invention is usually between about 0.01 and 5.0 weight percent. Preferably, however, the concentration of the fused aromatic additive in fuel is between about 0.05 and 1.0 weight percent, and most preferably between about 0.1 and 0.5 weight percent.

At a level lower than about 0.01 weight percent in fuel, the desired inhibition of the octane requirement increase usually is not observed, while concentrations of the fused aromatic compound of greater than about 5.0 weight percent in fuel are expected to lead to excessive dilution of the crankcase oil and/or build-up or combustion chamber deposits. The preferred upper level for the concentration of fused aromatic additive is usually selected to balance the cost of the fused aromatic additive with a decreasing efficiency for reducing the octane requirement increase.

Suitable liquid hydrocarbon fuels of the gasoline boiling range are mixtures of hydrocarbons boiling in the range from about 25° C. (77° F.) to about 232° C. (437° F.), and often comprise mixtures of saturated hydrocarbons, olefinic hydrocarbons and aromatic hydrocarbons. Preferred are gasoline blends consisting of or consisting essentially of a saturated hydrocarbon content ranging from about 40 to about 80 percent by volume, an olefinic hydrocarbon content from about 0 to about 30 percent by volume and an aromatic hydrocarbon content ranging from about 10 to about 60 percent by volume. The base fuel can be derived from straight run gasoline, polymer gasoline, natural gasoline, dimer and trimerized olefins, synthetically-produced hydrocarbon mixtures, from thermally or catalytically reformed hydrocarbons, or from catalytically cracked or thermally cracked petroleum stocks, and mixtures of these. The hydrocarbon composition and octane level of the base fuel are not critical. Any conventional motor fuel base may be employed in the practice of this invention.

Normally, the hydrocarbon fuel mixtures to which the invention is applied are substantially lead-free but may contain minor amounts of blending agents such as methanol, ethanol, methyl tertiary butyl ether, and the like. The fuels may also contain antioxidants such as phenolics, e.g., 2,6-di-tert-butylphenol or phenylenediamines, metal deactivators, dehazers such as polyester-type ethoxylated alkylphenolformaldehyde resins and the like. The fuels may also contain anti-knock compounds such as tetraethyl lead, a methyl cyclopentadienylmanganese tricarbonyl, ortho-azidophenol and the like.

The octane requirement reduction additive of the present invention can be introduced into the combustion zone of the engine in a variety of ways to prevent buildup of deposits, or to accomplish reduction or modification of deposits. Thus the ORR additive can be injected into the intake manifold intermittently or substantially continuously, preferably in a hydrocarbon carrier having a final boiling point (by ASTM D86) lower than about 232° C. (437° F.). A preferred method is to add the additive to the fuel. For example, the additive can be added separately to the fuel or blended with other fuel additives.

The invention further provides a concentrate for use in liquid hydrocarbon fuel in the gasoline boiling range comprising (a) from about 50 to 4000 grams per gallon of concentrate of the hereinabove described oil-soluble, fused aromatic compounds, (b) optionally from about 0.01 to 0.2 weight percent of a dehazer and (c) the balance of a diluent, boiling in the range from about 50° C. (122° F.) to about 232° C. (437° F.). Diluents may include hydrocarbons and oxygen-containing hydrocarbons. Suitable oxygen-containing hydrocarbon diluents include, e.g., methanol, ethanol, propanol, methyl tert-butyl ether and ethylene glycol monobutyl ether. The hydrocarbon diluent may be an alkane such as heptane but preferably is an aromatic hydrocarbon, such as toluene or xylene, alone or in admixture with said oxygen-containing hydrocarbon diluents. The optional dehazer is usually a polyester-type ethoxylated alkylphenolformaldehyde resin, but is not specifically limited thereto.

The following examples demonstrate the surprising suppression of octane requirement increase when utilizing an additive comprising the fused aromatic in a fuel for a spark ignited internal combustion engine. These examples are meant to be illustrative of the instant invention and not intended to limit the scope of the appended claims.

EXAMPLE 1

An initially clean 1973 350 CID V8 Chevrolet engine is utilized to compare the additive of the instant invention for the inhibition of octane requirement increase with Techron, a polyaminopolyether carbamate manufactured by Chevron Oil Company. The additives are added to the gasoline described in Table 1.

TABLE 1

| GASOLINE FUEL CHARACTERISTICS | |
|---|---|
| Characteristic | |
| Gravity @ 60° F. (°API) | 55.9 |
| Research Octane No. | 94.4 |
| Motor Octane No. | 84.6 |
| Reid Vapor Pressure (psi) | 8.7 |
| FIA (D 1319) wt % | |
| Aromatics | 33.0 |
| Olefins | 6.5 |
| Saturates | 60.5 |
| Distillation (D 86) °F. | |
| Initial | 96 |
| 10% | 125 |
| 30% | 184 |
| 50% | 225 |
| 70% | 266 |
| 90% | 334 |
| 95% | 360 |
| End Point | 420 |
| Sulfur (ppm) | 250 |
| % Carbon | 86.5 |

As a Carburetor Cleanliness Additive, oleylamine is added in a concentration of 14 pounds per thousand barrels.

The test consists of two parts, a deposit accumulation phase and a rating phase. During the deposit accumulation phase of the test, the engine is run on the cycle described in Table 2.

TABLE 2

| Step | Duration (Minutes) | Speed (RPM) | MPH | Load (BHP) | Temperature Jacket Out (°F.) | Temperature Oil Sump (°F.) |
|---|---|---|---|---|---|---|
| 1 | 2 | 700 | idle | 3 | 185 | 200–250 |
| 2 | 3 | 1700 | 45 | 15 | 185 | " |
| 3 | 4 | 1200 | 35 | 7 | 185 | " |
| 4 | 0.1 | 2225 | 60 | 100 | 185 | " |
| 5 | 3 | 2400 | 65 | 60 | 185 | " |

This cycle corresponds to an average speed of about 40 miles per hour.

During the rating phase of the test, in which the engine's octane requirement is rated, the engine is run under disc control. The disc contains a recording of the intake manifold vacuum and engine speed of a car being accelerated according to the Coordinating Research Council (CRC) modified Uniontown Rating Procedure. Using E-15 Octane Requirement Procedure 1983 CRC reference fuels are used during the rating phase to determine the octane requirement of the engine. The reference fuels utilized in this test include a primary reference fuel (PRF), a full boiling range unleaded fuel (FBRU) and a full boiling range sensitive unleaded fuel (FBRSU).

To test an additive, the engine is run on the standard gasoline described in Table 1 until a stabilized or equilibrium octane requirement of the clean engine is obtained. During equilibration, octane requirements are evaluated after 2, 24 and 100 hours of operation and every 100 hours thereafter until the requirement of the engine stops increasing, i.e. equilibrium has been reached. A typical ORI test lasts from 400 to 600 hours. Operation for about 500 hours is equivalent to about 20,000 miles.

Upon the engine reaching an equilibrated octane requirement, the engine is switched to fuel containing the additive, run for 6 hours on the deposit accumulation cycle summarized in Table 2, and rerated for octane requirement. A comparison of the ratings before and after the engine is run on additive-containing fuel determines the effectiveness of the additive.

To show the effectiveness of fused aromatic compounds for the reduction of octane requirement, phenanthrene and Techron, a known ORR agent, are compared in two tests, each using one of the additives in a concentration of 0.5 weight percent in the base fuel above described.

The results show that phenanthrene achieves the same reduction in octane requirement as Techron, reduction of one Research Octane Number, in 6 hours of operation for each of the three CRC standard fuels used, PRF, FBRU and FBRSU. Therefore phenanthrene is equally effective for reducing the octane requirement of an equilibrium engine as Techron, the current industry standard.

EXAMPLE 2

Polyisobutylphenanthrene was prepared by the following method. A 2 liter round-bottom flask equipped with a Dean-Stark water separator and a nitrogen purge was charged with 178.35 grams, or 1 mole, of phenanthrene, 600 grams or 1 mole of polyisobutene with an average molecular weight of 660, 60 grams of amberlyst 15 ion exchange resin and 200 milliliters of hexane. The reaction mixture was heated for 24 hours so that 2.1 milliliters of water was collected in the separator. The warm reaction mixture was then filtered and the solvent hexane was vacuum distilled from the filtrate, leaving the product as a white waxy solid.

EXAMPLE 3

To test the effectiveness of substituted fused aromatic compounds for reducing an established "equilibrium" octane requirement, polyisobutyl phenanthrene, which exhibits improved solubility in gasoline over unsubstituted phenanthrene, was added to the standard fuel described in Table 1 in an amount to produce 2.35 weight percent concentration in the fuel. The amount of phenanthrene contained in the fuel at this concentration of polyisobutyl phenanthrene is only 0.5 weight percent.

The engine test is essentially the same as that described in Example 1 starting with a previously equilibrated engine. After the test engine has run for 6 hours on fuel containing the phenanthrene as additive, the equilibrium octane requirement has been reduced by 2 to 3 Octane Numbers for each of the three CRC standard fuels tested, namely PRF, FBRU and FBRSU. The substituted additive, therefore, is between 2 and 3 times as effective for reducing an established octane requirement than is unsubstituted phenanthrene.

The enhanced solubility of gasoline containing polyisobutylphenanthrene and other gasoline solubilizing groups decreases the likelihood of forming deposits in the carburetor and increases the likelihood of the additive distributing evenly throughout the combustion chambers of the engine. In addition, increased solubility makes the additive easier to mix with the gasoline at refineries and terminals.

EXAMPLE 4

Comparative tests are conducted to determine the effect upon the rate of octane requirement increase when an initially clean engine is operated using the standard fuel described in Table 1 but containing 0.1 weight percent of phenanthrene as an octane requirement reducing additive.

Using the deposit accumulation cycle summarized in Table 2 and the E-15 octane requirement rating procedure described in Example 1, tests were conducted without and with 0.1 weight percent of phenanthrene in a standard full boiling range unleaded gasoline. The amount of octane requirement increase in an initially clean engine was determined periodically with the results summarized in Table 3.

TABLE 3

COMPARISON OF OCTANE REQUIREMENT BUILDUP TESTS

| Type of Fuel | Hours of Operation | FBRU Octane Requirements |
|---|---|---|
| Test 1 | | |
| 0.1 wt. % Phenanthrene Additive | 25 | 80 |
| | 140 | 83 |
| | 260 | 84 |
| | 355 | 84 |
| Test 2 | | |
| No additive | 25 | 80 |
| | 100 | 84 |
| | 350 | 88 |
| | 700 | 89 |

As can be seen by comparing the results summarized in Table 3, the engine run with fuel containing phenanthrene as additive underwent substantially less octane requirement increase than did the same engine run on fuel containing no additive. In Test 1 after 355 hours of operation using fuel containing the polynuclear additive, the octane requirement increase was 6 Research Octane Numbers; whereas in Test 2 the octane requirement increase for fuel containing no additive was 10 Research Octane Numbers. Therefore, it can be seen that when the fused aromatic additives of this invention are incorporated into fuel used in a new or clean engine, a lower octane fuel is required to run the engine without knocking after equilibration is reached.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the appended claims.

We claim:

1. A fuel composition comprising a hydrocarbon liquid consisting essentially of components boiling within the gasoline range having dissolved therein an octane requirement increase-inhibiting amount of one or more fused aromatic compounds having aromatic rings containing no heteroatoms in the ring structure selected from the group consisting of acenaphthylene, benzanthracene, naphthalene, anthracene, phenanthrene, amino anthracene, chrysene, coronene, 1,2,3,4-dibenzanthracene, 1,2,4,6-dibenzanthracene, 9,10-diphenyl anthracene, pentacene, perylene, pyrene, rubrene, and triphenylene.

2. The composition of claim 1 wherein the concentration of the fused aromatic additive is between about 0.01 and about 5.0 weight percent of the fuel.

3. The composition of claim 1 wherein the fused aromatic compounds are selected from the group consisting of unsubstituted naphthalene, anthracene and phenanthrene.

4. The composition of claim 1 wherein the concentration of the fused aromatic compounds is between about 0.05 and 1.0 weight percent of the fuel.

5. The composition of claim 1 wherein the substituted fused aromatic compound is phenanthrene.

6. A method for operating a spark ignition engine which comprises introducing a combustion intake charge to the engine comprising the composition of claim 1, 2, 3, 4, or 5.

7. A fuel composition comprising a mixture of a hydrocarbon consisting essentially of components of the gasoline boiling range with a fused aromatic additive dissolved therein, said additive comprising one or more fused aromatic compounds selected from the group consisting of acenaphthylene, benzanthracene, naphthalene, anthracene, phenanthrene, amino anthracene, chrysene, coronene, 1,2,3,4-dibenzanthracene, 1,2,4,6-dibenzanthracene, 9,10-diphenyl anthracene, pentacene, perylene, pyrene, and triphenylene in a concentration between about 0.01 and 5.0 weight percent.

8. The composition of claim 7 wherein the fused aromatic additive is selected from the group consisting of naphthalene, anthracene and phenanthrene.

9. The composition of claim 7 wherein the concentration of the fused aromatic additive is between about 0.05 and 1.0 weight percent of the composition.

10. The composition of claim 7 wherein the concentration of the fused aromatic additive is between about 0.1 and 0.5 weight percent of the composition.

11. A method for operating a spark ignition engine which comprises introducing with the combustion intake charge to the engine the composition of claims 7, 8, 9, or 10.

12. A concentrate suitable for use in liquid hydrocarbon fuel consisting essentially of components in the gasoline boiling range, said concentrate comprising:

(a) an additive comprising a fused aromatic compound selected from the group consisting of acenaphthylene, benzanthracene, naphthalene, anthracene, phenanthrene, amino anthracene, chrysene, coronene, 1,2,3,4-dibenzanthracene, 1,2,4,6-dibenzanthracene, 9,10-diphenyl anthracene, pentacene, perylene, pyrene, rubrene, and triphenylene and (b) a fuel compatible diluent boiling in the range of from about 50° C. (122° F.) to about 232° C. (437° F.).

13. The concentrate of claim 12 wherein the fused aromatic is selected from the group consisting of unsubstituted naphthalene, anthracene, and phenanthrene.

14. The concentrate of claim 12 wherein the fused aromatic is phenanthrene.

15. The concentrate of claim 12 wherein the diluent is selected from the group consisting of hydrocarbons, oxygenated hydrocarbons, and mixtures thereof.

16. The concentrate of claim 12 wherein the hydrocarbon fuel is an aromatic hydrocarbon.

17. The concentrate of claim 12 wherein the fused aromatic compound is present at a concentration between about 50 and 4000 grams per gallon of said concentrate.

18. A fuel composition for operating a spark ignition engine which comprises a liquid hydrocarbon fuel of the gasoline boiling range and a fused aromatic compound selected from the group consisting of acenaphthylene, benzanthracene, naphthalene, anthracene, phenanthrene, amino anthracene, chrysene, coronene, 1,2,3,4-dibenzanthracene, 1,2,4,6-dibenzanthracene, 9,10-diphenyl anthracene, fluoranthene, pentacene, perylene, pyrene, rubrene, and triphenylene, the fused aromatic compound having a concentration of between about 0.05 and 1 weight percent.

19. The composition of claim 1 or 7 wherein said aromatic compound is substituted with an inorganic species bonded to a carbon atom in the ring structure of one of the fused rings.

20. The composition of claim 1 or 7 wherein said aromatic compound is substituted with one or more organic radicals or inorganic species bonded to carbon atoms in the ring structure of said aromatic rings.

* * * * *